US008430047B1

(12) United States Patent
Dill

(10) Patent No.: US 8,430,047 B1
(45) Date of Patent: Apr. 30, 2013

(54) PERSONAL WATERCRAFT STABILIZER

(76) Inventor: James C. Dill, McCurtain, OK (US)

( * ) Notice: Subject to any disclaimer, the term of this patent is extended or adjusted under 35 U.S.C. 154(b) by 183 days.

(21) Appl. No.: 12/904,186

(22) Filed: Oct. 14, 2010

(51) Int. Cl.
*B63H 25/06* (2006.01)

(52) U.S. Cl.
USPC ..... 114/162

(58) Field of Classification Search ..... 114/162, 114/165, 166, 167, 168, 172
See application file for complete search history.

(56) References Cited

U.S. PATENT DOCUMENTS

| | | | | |
|---|---|---|---|---|
| 4,165,704 | A | 8/1979 | West, Jr. | |
| 4,290,760 | A | 9/1981 | Lindblad | |
| 4,634,388 | A | 1/1987 | Covell | |
| 4,862,818 | A | 9/1989 | Sullivan | |
| 4,936,243 | A | 6/1990 | Shields | |
| 4,944,702 | A | 7/1990 | Cain | |
| 5,509,835 | A * | 4/1996 | Henderson et al. | 440/63 |
| 5,902,157 | A | 5/1999 | Boris | |
| 7,056,166 | B2 * | 6/2006 | Bernloehr | 440/6 |
| 7,182,032 | B1 | 2/2007 | Lindemann | |

* cited by examiner

*Primary Examiner* — Daniel Venne
(74) *Attorney, Agent, or Firm* — Robert C. Montgomery; Montgomery Patent & Design

(57) ABSTRACT

An apparatus that attaches to a small boat designed to stabilize a first end of the boat against the wind while a trolling motor stabilizes a second end is herein disclosed. The apparatus generally comprises a clamp that attaches it to the side of the hull and a moveable shaft that holds a large piece of plastic which is partially submerged under the water. The apparatus is positioned such that it is perpendicular to the direction in which the wind is blowing. As such, as wind pushes against the side of the boat, resistance will be offered by the device as the wind must push it against the water as well. It can be quickly raised and lowered as required by the needs of the boat occupants. These features provide in effect, an "anchor" which stabilizes the boat against the wind.

17 Claims, 4 Drawing Sheets

PERSONAL WATERCRAFT STABILIZER

RELATED APPLICATIONS

The present invention was first described in a notarized Official Record of Invention on Aug. 24, 2009, that is on file at the offices of Montgomery Patent and Design, LLC, the entire disclosures of which are incorporated herein by reference.

FIELD OF THE INVENTION

The present invention relates generally to fishing boat accessories, and in particular, to a stabilizing rudder attachment for a small fishing boat.

BACKGROUND OF THE INVENTION

Fishing is a sport enjoyed around the world. After the fishing rod and tackle box, the fishing boat is one of the most common pieces of equipment used while fishing. One (1) of the most common types of boats, especially for use in shallow waters, is the flat bottomed or "Jon" boat. Such boats are easily maneuverable and provide a large amount of floor space capable of accommodating multiple fishermen.

One (1) problem associated with these types of small boats is their tendency to be blown about by even slight winds. A common method of combating windy conditions is to constantly adjust the trolling motor such that it counteracts the unwanted movements of the boat. This effort not only takes away from the enjoyment of fishing, but repeated trolling motor activity tends to scare away the fish. Furthermore, such a process can be time consuming and inefficient.

Various attempts have been made to provide stabilizing attachments for boats. Examples of these attempts can be seen by reference to several U.S. patents. U.S. Pat. No. 4,862,818, issued in the name of Sullivan, describes a canoe stabilizing and guide mechanism which provides a bracketing means for mounting a canoe paddle outboard of the canoe.

U.S. Pat. No. 4,936,243, issued in the name of Shields, describes a transom rudder seat which provides a chair securable to a transom portion of a boat with a lower portion of the attachment comprising an anti-drift fin.

U.S. Pat. No. 5,902,157, issued in the name of Boris, describes a rudder attachment for a trolling motor. The rudder attachment includes forward and rearward portions which secure to the motor with a plurality of tie wrap fasteners.

While these devices fulfill their respective, particular objectives, each of these references suffer from one (1) or more of the aforementioned disadvantages. Many such devices are difficult to install. Also, many such devices are not readily deployable and retractable. Furthermore, many such devices are not readily adjustable based upon changing weather conditions or wind patterns. Accordingly, there exists a need for a personal watercraft stabilizer without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a personal watercraft stabilizing device which is simple to attach, deploy, and adjust. Thus, the object of the present invention is to solve the aforementioned disadvantages and provide for this need.

To achieve the above objectives, it is an object of the present invention to provide stabilization to an existing small watercraft, particularly against movement caused by the wind.

Another object of the present invention is to reduce watercraft movement caused from being blown around by the wind and prevent unintentional reorientation of the watercraft during usage. The apparatus comprises a shaft, a rudder member, and an adjusting member which allows a user to manipulate the rudder member in an opposing direction to a wind force to assist in stabilizing the watercraft.

Yet still another object of the present invention is to enable depth and angle adjustment of the rudder member's position by the shaft and adjusting member. The rudder member comprises a rudder which is rigidly attached to the shaft with a pair of brackets and a plurality of fasteners. The shaft comprises a handle portion which enables the user to manipulate the orientation of the rudder within the adjusting member.

Yet still another object of the present invention is to secure the shaft to adjusting member with sleeve and collar portions of the adjusting member.

Yet still another object of the present invention is to provide discrete angular adjustment of the rudder relative to the watercraft. The adjustment member comprises a spring pin and a plurality of teeth. The spring pin engages the shaft and allows a user to selectively compress the spring pin, rotate the shaft to a desired tooth, and release the pin to lock the shaft and rudder into place.

Yet still another object of the present invention is to allow a user to secure the apparatus to a transom portion of the watercraft by a clamping mechanism integral to the adjusting member.

Yet still another object of the present invention is to provide a method of utilizing the device that provides a unique means of acquiring an instance of the apparatus, installing the adjusting member of the apparatus along a desired position on the transom of an existing watercraft, clamping the adjusting member to the transom, securing the shaft to the adjusting member at a desired length with the sleeve and collar assembly, adjusting the shaft and attached rudder member via the spring pin angular adjustment assembly, readjusting the apparatus as desired, and utilizing the apparatus to stabilize the watercraft by mitigating the effects of random wind movements.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | personal watercraft stabilizer |
| 15 | watercraft |
| 16 | transom portion |
| 17 | water |
| 20 | shaft |
| 25 | handle |
| 30 | rudder member |
| 31 | rudder |
| 32 | bracket |
| 33 | bracket aperture |
| 34 | fastener |
| 40 | adjusting member |
| 41 | sleeve |
| 42a | upper collar |
| 42b | lower collar |
| 43a | fastening means |
| 43b | fastening aperture |
| 44 | first pivoting member |
| 45 | second pivoting member |
| 46 | teeth |
| 47a | pivot point |
| 47b | pivot axle |
| 48 | first arm |
| 49 | second arm |
| 50 | brace |
| 51 | extension member |
| 52 | spring pin |
| 53 | square pin |
| 54 | clamping fastener |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a personal watercraft stabilizer (herein described as the "apparatus") 10, which provides a means for stabilizing an existing small watercraft 15 such as, but not limited to: a flat bottom boat, a Jon boat, or the like from the wind. The apparatus 10 reduces watercraft 15 movement caused from being blown around by the wind, thereby reducing reorienting said watercraft 15 during usage. The apparatus 10 takes a form similar to a common trolling motor and may be suited at the bow or stern of the watercraft 15 as desired by the user of said watercraft 15.

Figure 1:
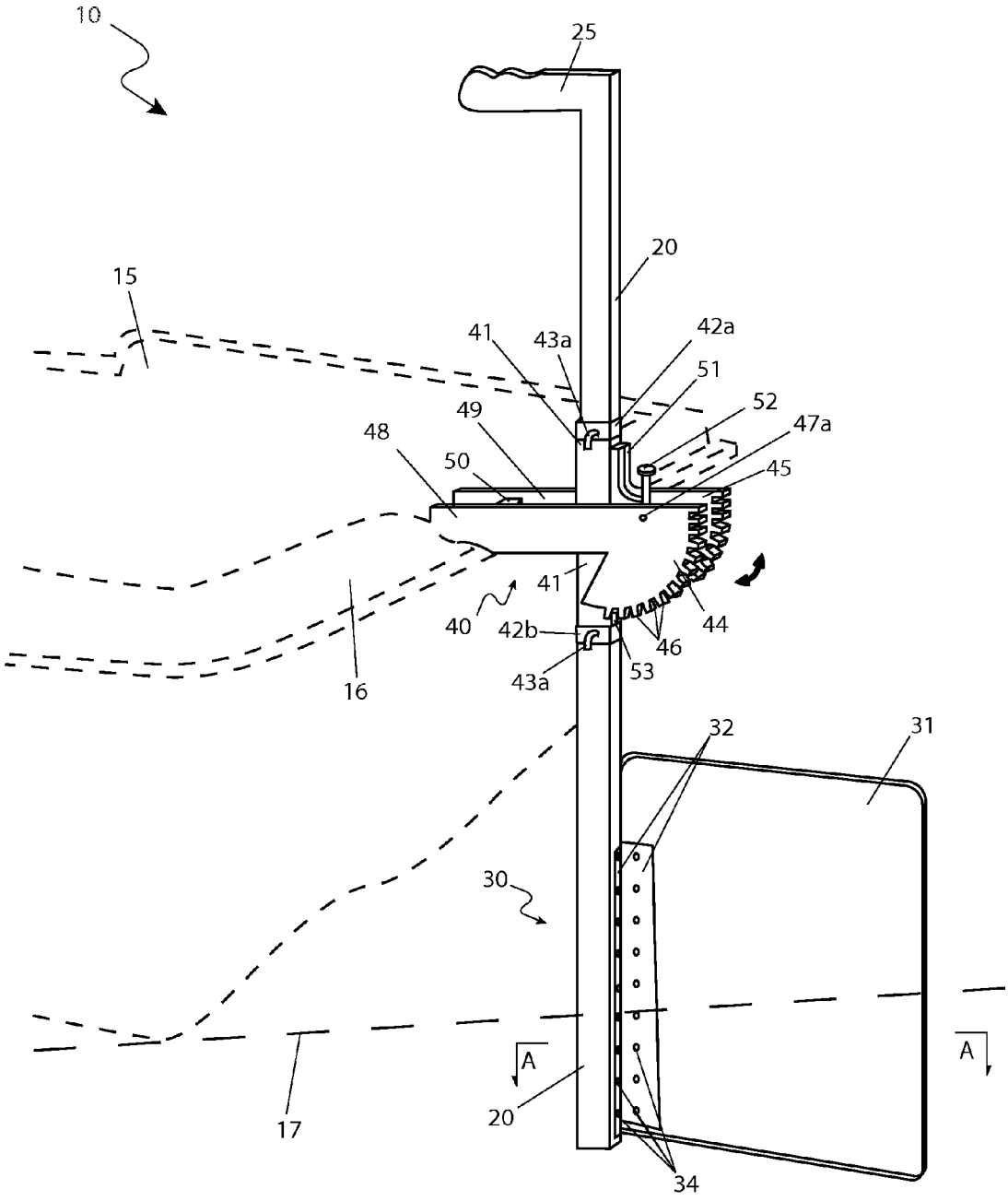
FIG. 1 is an environmental view of a personal watercraft stabilizer 10, according to a preferred embodiment of the present invention.
Figure 2:
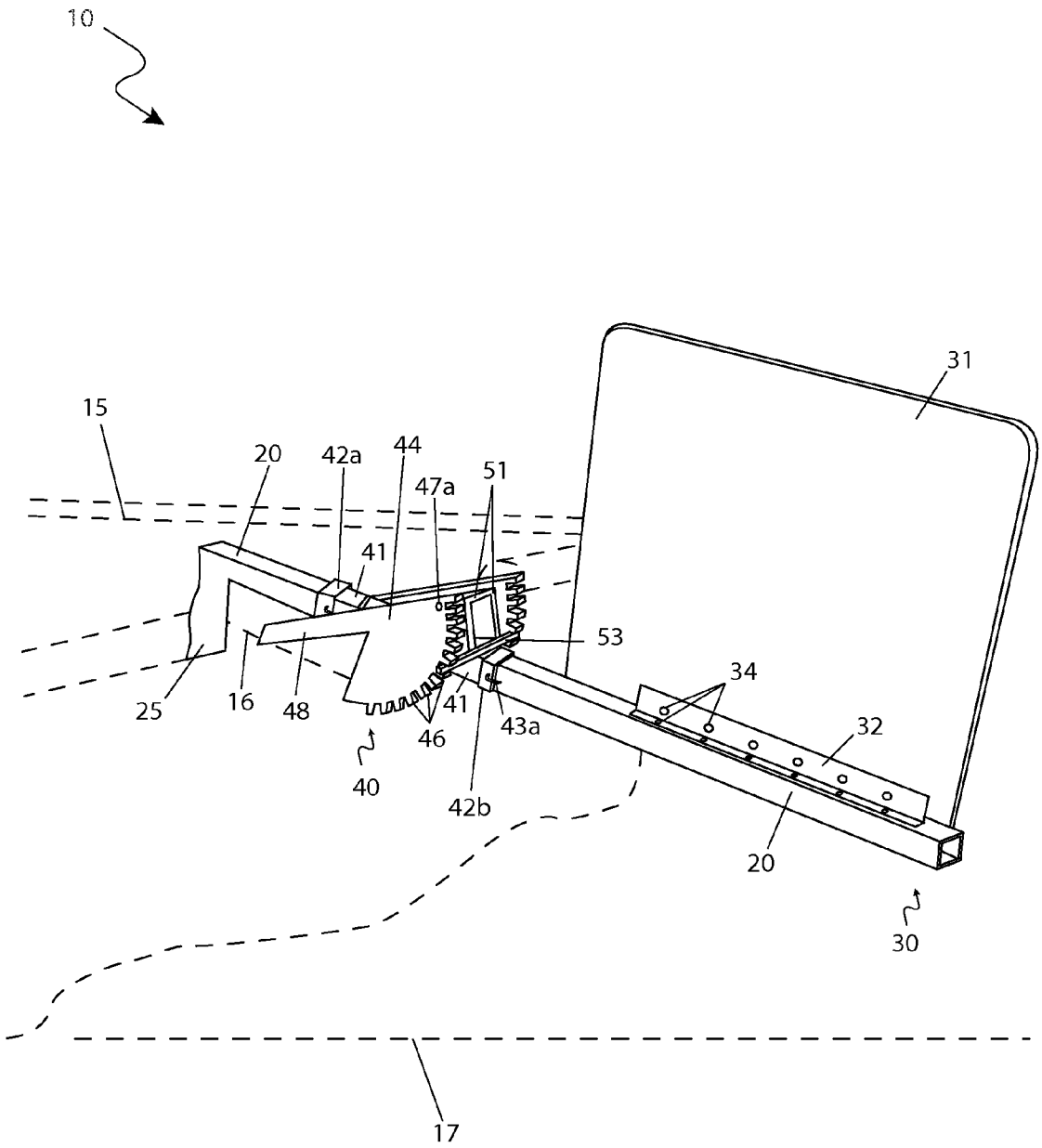
FIG. 2 is another environmental view of the personal watercraft stabilizer 10, according to a preferred embodiment of the present invention.

Referring now to FIG. 1, an environmental view of the apparatus 10 and FIG. 2, another environmental view of the apparatus 10, according to the preferred embodiment of the present invention, are disclosed. The apparatus 10 is approximately four (4) feet in length and is removably attachable and adjustable to a transom portion 16 on the watercraft 15. The apparatus 10 comprises a shaft 20, a rudder member 30, and an adjusting member 40. During use, the shaft 20 is positioned in a vertical orientation (see FIG. 1) so that the rudder member 30 is partially submerged in a desired body of water 17. As the wind applies a force to the watercraft 15, a user manipulates the rudder member 30 to apply a force to the water 17 in an opposing direction to assist in stabilizing said watercraft 15. After use, the shaft 20 is positioned in a desired angled orientation (see FIG. 2) so that the rudder member 30 is completely out of the body of water 17. The depth of the rudder member 30 is adjusted and angled via the adjusting member 40 (see FIG. 4), thereby enabling the user to easily manipulate the position of said rudder member 30.

Figure 3:
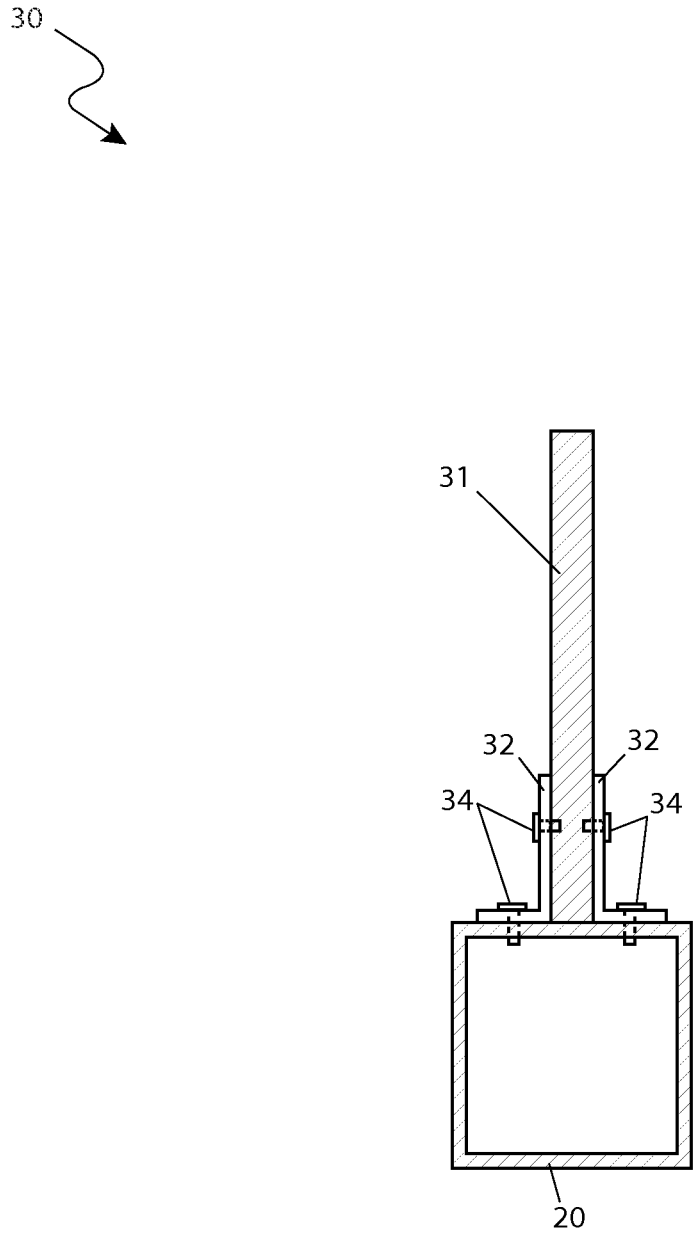
FIG. 3 is a section view of a rudder member 30 taken along line A-A (see FIG. 1), according to a preferred embodiment of the present invention; and, FIG. 4 is an exploded view of the personal watercraft stabilizer 10, according to a preferred embodiment of the present invention.

Referring now to FIG. 3, a section view of the rudder member 20 taken along line A-A (see FIG. 1), according to the preferred embodiment of the present invention, is disclosed. The rudder member 30 comprises a rudder 31, a pair of brackets 32, and a plurality of fasteners 34. The rudder 31 is generally rectangular and fabricated from a durable plastic, yet other materials may be utilized without limiting the scope of the apparatus 10. The rudder 31 is approximately a half (½) an inch in width, fourteen (14) inches in length, and twenty (20) inches in height. The rudder 31 is attached to a lower front surface of the shaft 20 (also see FIG. 4) via a bracket 32 mounted to each opposing longitudinal surface of the rudder 31. Each bracket 32 is fabricated from materials such as, but not limited to: aluminum, stainless steel, plastic, or the like and is attached to the rudder 31 and to the shaft 20 via a plurality of fasteners 34 such as, but not limited to: screws, rivets, or the like.

Figure 4:
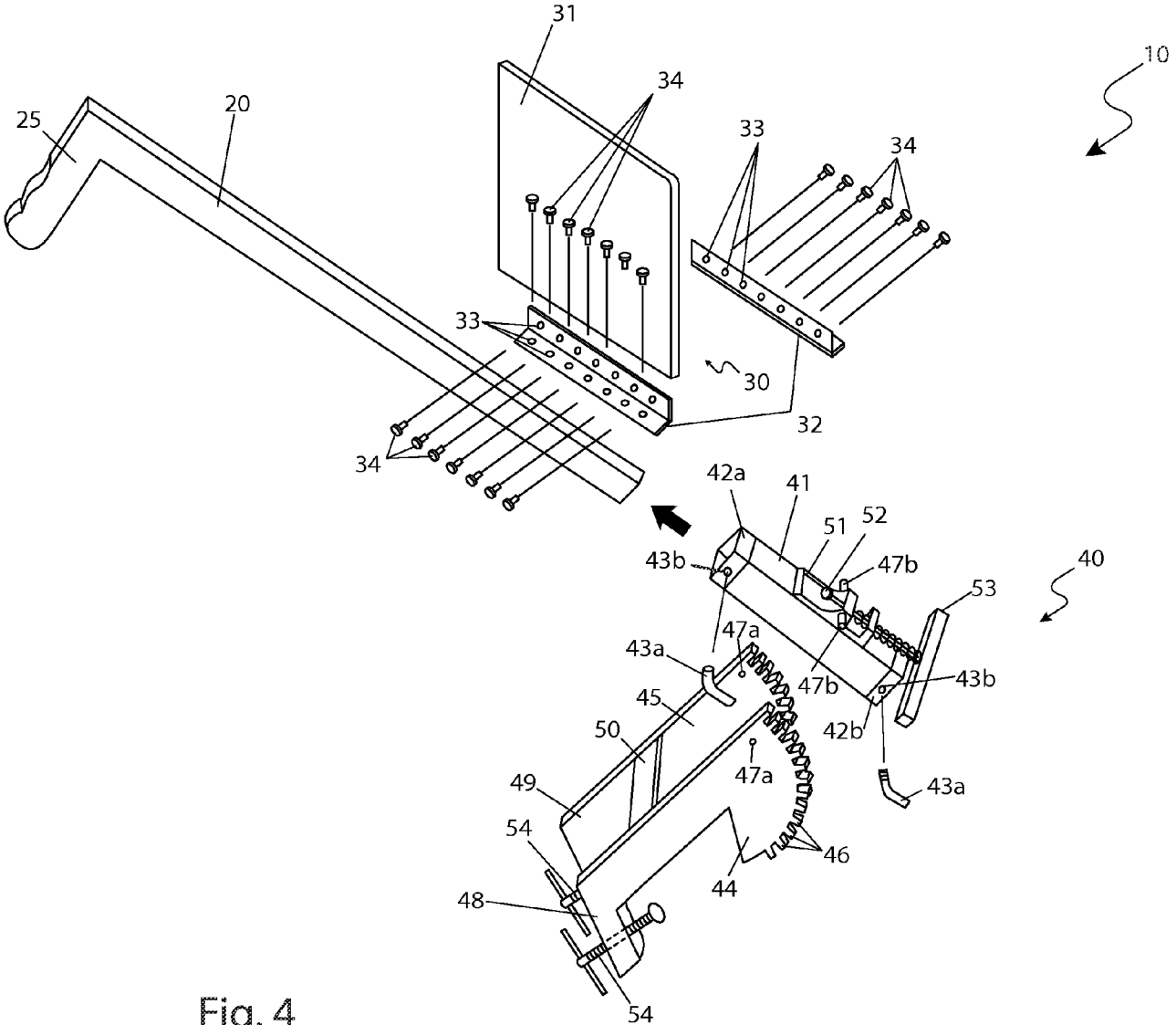

Referring now to FIG. 4, an exploded view of the apparatus 10, according to the preferred embodiment of the present invention, is disclosed. The shaft 20 is generally "L"-shaped comprising a rectangular cross-section and is fabricated from aluminum or other similar materials which comprise dimensions approximately measuring one-and-a-half (1½) inches square by fifty-two (52) inches in length. The shaft 20 enables the user to manipulate the orientation of the rudder member 30 via a handle portion 25. The handle portion 25 is integrally molded in a perpendicular orientation to an upper surface of the shaft 20 and comprises an ergonomic body to enable the user to comfortably maneuver the apparatus 10.

The adjusting member 40 is slidably inserted onto the shaft 20 at a desired height which corresponds to the desired position of the rudder member 30. The adjusting member 40 enables an attachment means to the transom portion 16, thereby securing the apparatus 10 to the watercraft 15 (see herein below). The body of the adjusting member 40 is comprised of a sleeve 41 which comprises a rectangular cross-section slightly larger than that of the shaft 20 which enables insertion of said sleeve 41 onto said shaft 20. The sleeve 41 is fastened to the shaft 20 via an upper collar **42*a* and a lower collar 42*b* which further comprise a fastening aperture 43*b* on a side surface of each collar 42*a*, 42*b*. The sleeve 41 and collars 42*a*, 42*b* are preferably comprised of materials such as, but not limited to: aluminum, stainless steel, plastic, or the like. The fastening apertures 43*b* enable a fastening means 43*a* to abut against the shaft 20 in a threadably engaging means into said fastening apertures 43*b* to attach the sleeve 41 onto said shaft 20. Each fastening means 43*a*, comprises an "L"-shaped body fabricated from materials such as, but not limited to: steel, plastic, or the like comprising a threaded shaft to enable the user to manually thread said fastening means 43*a* into each fastening apertures 43*b***.

A front surface of the sleeve 41 comprises an integrally molded extension member 51 which provides a securing means to a conventional spring pin 52 and provides a pivoting means to a first pivoting member 44 and a second pivoting member 45. The spring pin 52 is inserted downwardly through an opening in the extension member 51 and provides the adjusting means to the apparatus 10. The spring pin 52 is comprised of a tubular shaft encompassed by a conventional compression spring and further comprising a square pin 53 on a lower intermediate surface positioned in a perpendicular orientation to said spring pin 52. In use, an upper portion of the spring pin 52 is depressed to compress the compression spring and release the square pin 53 from a plurality of teeth 46 on the first pivoting member 44 and the second pivoting member 45, thereby enabling the apparatus 10 to be rotated in a desired position.

Each pivoting member 44, 45 comprises an arcuate distal portion further comprising a plurality of teeth 46 on a perimeter edge which enable the square pin 53 to be positioned between a desired pair of teeth 46 on each said pivoting member 44, 45 to position the apparatus 10 in a desired angle. Each pivoting member 44, 45 also comprises a pivot point 47*a* which is the position where a pivot axle 47*b* attaches each of said pivoting members 44, 45 to the extension member 51, thereby enabling the adjusting member 40 to rotate. A pivot axle 47*b* is positioned on each side of the extension 51 and each said pivot axle 47*b* extends outwardly from the extension member 51 and receives a pivot point 47*a* via a friction fitting means.

The pivoting members 44, 45 are attached to each other via a brace 50. The brace 50 is preferably integrally molded to the upper perimeter edges of each pivoting member 44, 45, yet other attachment means may be utilized without limiting the scope of the apparatus 10. The brace 50 also spaces the pivoting members 44, 45 in a separate and parallel orientation.

The first pivoting member 44 and the second pivoting member 45 extend into a first arm 48 and a second arm 49, respectively, to attach the adjusting member 40 to the transom 16. Each arm 48, 49 is "L"-shaped to enable the pivoting member 44, 45 to clasp onto the transom 16. Each lower portion of the arms 48, 49 comprise a conventional digit-operated clamping fastener 54 which threadably engage to an inner portion of the transom 16. The clamping fastener 54 comprises expected features such as a swivel pad which engages the transom 16 and a sliding pin handle which is utilized to adjust the clamping fastener 54. In use, each pivoting member 44, 45 is positioned upon the transom 16 with the arms 48, 49 positioned at a rear surface of said transom 16 and the teeth 46 positioned away from the watercraft 15. Each clamping fastener 54 is then rotated to engage the rear portion of the transom 16, thereby attaching the adjusting member 40 to the watercraft 15.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: acquiring the apparatus 10; locating the transom 16 on a watercraft 15; positioning the adjusting member 40 onto the transom 16 with the arms 48, 49 of each pivoting member 44, 45 positioned at a rear surface of said transom 16 and the teeth 46 positioned away from the watercraft 15; threadably engaging the clamping fasteners 54 onto each arm 48, 49 and clamping each arm 48, 49 onto a rear portion of the transom 16; positioning the rudder member 30 at a desired position via depressing the spring pin 52 to release the square pin 53 from the teeth 46 on each pivoting member 44, 45 and rotating the shaft 20 via grasping the handle 25; releasing the spring pin 52 to set the square pin 53 between a desired set of teeth 46 at a desired position; adjusting the height of the shaft 20 via unfastening each fastening means 43*a* from each collar 42*a*, 42*b* to enable said shaft 20 to freely move within the sleeve 41, thereby positioning the rudder member 30 to a partially submerged position in the water 17; refastening each fastening means 43*a* to each collar 42*a*, 42*b* to secure said sleeve 41 to the shaft 20; and, utilizing the apparatus 10 to provide a stabilized watercraft 15 against random wind movements and reducing the aggravation of constant adjustments of said watercraft 15.

The method of angling the apparatus 10 may be achieved by performing the following steps: depressing the spring pin 52 to release the square pin 53 from the teeth 46 on each pivoting member 44, 45 and rotating the shaft 20 downwardly via grasping the handle 25; and, releasing the spring pin 52 to set the square pin 53 between a desired set of teeth 46.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A stabilizer for a personal watercraft, comprising:

a shaft, comprising a lower portion, an intermediate portion, and an upper portion;

a rudder member affixed to a front surface of said lower portion of said shaft, comprising:

a generally rectangular lightweight rudder body; and, a pair of brackets, each fastened to opposing longitudinal surfaces of said rudder body; and, an adjusting member attached to said intermediate portion of said shaft;

wherein said adjusting member removably and adjustably attaches said stabilizer to said watercraft such that said shaft is vertically disposed along an outer surface of said watercraft;

wherein said rudder member is placed at a desired depth within a body of water based on a desired placement of said adjusting member on said shaft;

wherein said stabilizer is adjustable between a deployed position and a stored position;

wherein said rudder member is at least partially submerged within said body of water when said stabilizer is in said deployed position; and, wherein a user manipulates said stabilizer to direct said rudder member within said body of water when said watercraft is in motion, thereby providing a stabilizing force to said watercraft when acted upon by a force of wind.

2. The stabilizer of claim 1, wherein said shaft further comprises a generally L-shaped body.

3. The stabilizer of claim 1, wherein said rudder body comprises dimensions of approximately a half an inch in width, fourteen inches in length, and twenty inches in height.

4. The stabilizer of claim 1, wherein said stabilizer is approximately four feet in length.

5. The stabilizer of claim 1, wherein said adjusting member further comprises:

a sleeve;

an upper collar located at an upper edge of said sleeve, further having a fastening aperture for receiving a fastener for securing said upper edge of said sleeve to said shaft;

a lower collar located at a lower edge of said sleeve, further having a fastening aperture for receiving a fastener for securing said lower edge of said sleeve to said shaft;

an extension member comprising an integral portion of a front surface of said sleeve;

a pair of pivoting members, each comprising a clamping fastener for adjustably removably attaching said stabilizer to said transom portion of said watercraft; and, an adjustment assembly located on an lower portion of said extension member operably adjusting an angle of said pair of pivoting members;

wherein said sleeve is placed over said shaft at a desired location at said intermediate portion of said shaft; and, wherein said adjusting member selectably adjusts a desired angle of said rudder member of said stabilizer.

6. The stabilizer of claim 5, wherein said pair of pivoting members each further comprises:

an arm portion located at a distal end, comprising an elongated structural L-shaped member;

a brace, comprising an integral portion of an upper portion of each said arm portion and interconnecting said pair of pivoting members in a parallel orientation;

an arcuate distal portion further comprising a plurality of teeth on a perimeter edge; and, a pivot axle attaching each of said pivoting members at a pivot point to opposing sides of said extension member;

wherein said clamping fastener is located on each of said arm portions of said pair of pivoting members, wherein said arm portion abuts a transom portion of said watercraft;

wherein said pivot axle enables said pair of pivoting members to rotatably move in relation to said extension member; and, wherein said adjustment assembly is selectably adjusted to said desired angle by engaging one aligned pair of said plurality of teeth.

7. The stabilizer of claim 6, wherein said:

clamping fastener is located on each of said arm portions of said pair of pivoting members, further comprising a swivel pad and a sliding pin handle;

wherein said transom portion of said watercraft is secured between said pair of arms and each swivel pad.

8. The stabilizer of claim 6, wherein said adjustment assembly further comprises:

a tubular shaft encompassed by a spring inserted downwardly through an opening in said extension member;

a contact pad at an upper edge of said tubular shaft; and, a pin located at a lower edge of and oriented perpendicular to said tubular shaft;

wherein said pin engages said one aligned pair of said plurality of teeth of said pair of pivoting members to adjust to said desired angle; and, wherein said pin disengages said one aligned when a force acts upon said contact pad.

9. A stabilizer for a personal watercraft, comprising:

a shaft, comprising a lower portion, an intermediate portion, and a handle located at an upper portion;

a rudder member affixed to a front surface of said lower portion of said shaft, comprising:

a generally rectangular lightweight rudder body; and.

a pair of brackets, each fastened to opposing longitudinal surfaces of said rudder body; and, an adjusting member attached to said intermediate portion of said shaft;

wherein said adjusting member removably and adjustably attaches said stabilizer to said watercraft such that said shaft is vertically disposed along an outer surface of said watercraft;

wherein said rudder member is placed at a desired depth within a body of water based on a desired placement of said adjusting member on said shaft;

wherein said stabilizer is adjustable between a deployed position and a stored position;

wherein said rudder member is at least partially submerged within said body of water when said stabilizer is in said deployed position; and, wherein a user manipulates said stabilizer to direct said rudder member within said body of water when said watercraft is in motion, thereby providing a stabilizing force to said watercraft when acted upon by a force of wind.

10. The stabilizer of claim 9, wherein said shaft further comprises a generally L-shaped lightweight body.

11. The stabilizer of claim 9, wherein said handle further comprises an ergonomic member horizontally extending outward from said shaft.

12. The stabilizer of claim 9, wherein said rudder body comprises dimensions of approximately a half an inch in width, fourteen inches in length, and twenty inches in height.

13. The stabilizer of claim 9, wherein said stabilizer is approximately four feet in length.

14. The stabilizer of claim 9, wherein said adjusting member further comprises:

a sleeve;

an upper collar located at an upper edge of said sleeve, further having a fastening aperture for receiving a fastener for securing said upper edge of said sleeve to said shaft;

a lower collar located at a lower edge of said sleeve, further having a fastening aperture for receiving a fastener for securing said lower edge of said sleeve to said shaft;

an extension member comprising an integral portion of a front surface of said sleeve;

a pair of pivoting members, each comprising a clamping fastener for adjustably removably attaching said stabilizer to said transom portion of said watercraft; and, an adjustment assembly located on an lower portion of said extension member operably adjusting an angle of said pair of pivoting members;

wherein said sleeve is placed over said shaft at a desired location at said intermediate portion of said shaft; and, wherein said adjusting member selectably adjusts a desired angle of said rudder member of said stabilizer.

15. The stabilizer of claim 14, wherein said pair of pivoting members each further comprises:

an arm portion located at a distal end, comprising an elongated structural L-shaped member;

a brace, comprising an integral portion of an upper portion of each said arm portion and interconnecting said pair of pivoting members in a parallel orientation;

an arcuate distal portion further comprising a plurality of teeth on a perimeter edge; and, a pivot axle attaching each of said pivoting members at a pivot point to opposing sides of said extension member;

wherein said arm portion abuts a transom portion of said watercraft;

wherein said pivot axle enables said pair of pivoting members to rotatably move in relation to said extension member; and, wherein said adjustment assembly is selectably adjusted to said desired angle by engaging one aligned pair of said plurality of teeth.

16. The stabilizer of claim 15, wherein said:

clamping fastener is located on each of said arm portions of said pair of pivoting members, further comprising a swivel pad and a sliding pin handle;

wherein said transom portion of said watercraft is secured between said pair of arms and each swivel pad.

17. The stabilizer of claim 15, wherein said adjustment assembly further comprises:

a tubular shaft encompassed by a spring inserted downwardly through an opening in said extension member;

a contact pad at an upper edge of said tubular shaft; and, a pin located at a lower edge of and oriented perpendicular to said tubular shaft;

wherein said pin engages said one aligned pair of said plurality of teeth of said pair of pivoting members to adjust to said desired angle; and, wherein said pin disengages said one aligned when a force acts upon said contact pad.

* * * * *